US005358468A

United States Patent [19]

Longo et al.

[11] Patent Number: 5,358,468

[45] Date of Patent: Oct. 25, 1994

[54] ADJUSTABLE RESISTANCE KNEE REHABILITATING AND STRENGTHENING APPARATUS

[75] Inventors: Matthew C. Longo, 1800 Liberty Dr., Pueblo, Colo. 81006; John C. Vukich; Jon A. Genova, both of Pueblo, Colo.

[73] Assignee: Matthew C. Longo, Pueblo, Colo.

[21] Appl. No.: 38,630

[22] Filed: Mar. 26, 1993

[51] Int. Cl.[5] ..... A61H 1/02

[52] U.S. Cl. ..... 601/33; 601/105; 602/16; 482/112

[58] Field of Search ..... 482/79, 80, 112; 602/16, 23; 128/25 B, 25 C, 25 R, 53, 61, 882; 5/624; 601/33, 105

[56] References Cited

U.S. PATENT DOCUMENTS

| | | | |
|---|---|---|---|
| 3,976,057 | 8/1976 | Barclay | 128/25 R |
| 4,291,787 | 9/1981 | Brentham | 482/111 |
| 4,718,665 | 1/1988 | Airy et al. | 272/132 |
| 4,766,892 | 8/1988 | Kreitman | 128/882 |
| 4,801,138 | 1/1989 | Airy et al. | 272/130 |
| 4,817,588 | 4/1989 | Bledsoe | 602/16 |
| 4,982,732 | 1/1991 | Morris | 602/16 |
| 5,013,037 | 5/1991 | Stermer | 272/139 |
| 5,052,375 | 10/1991 | Stark et al. | 128/25 R |
| 5,052,379 | 10/1991 | Airy et al. | 482/112 |
| 5,103,811 | 4/1992 | Crupi, Jr. | 602/16 |
| 5,116,296 | 5/1992 | Watkins et al. | 482/91 |
| 5,123,333 | 6/1992 | Sollami | 92/125 |

FOREIGN PATENT DOCUMENTS

| | | | |
|---|---|---|---|
| 3422685 | 12/1985 | Fed. Rep. of Germany | 602/16 |

*Primary Examiner*—Richard J. Apley
*Assistant Examiner*—Jeanne M. Mollo
*Attorney, Agent, or Firm*—John R. Flanagan

[57] ABSTRACT

A knee rehabilitating and strengthening apparatus includes upper and lower frame assemblies being securable around a thigh and a shin of a user's leg above and below a knee joint, and a pair of separate torque unit assemblies disposed between the upper and lower frame assemblies at opposing lateral sides of and in alignment with the knee joint and pivotally interconnecting the upper and lower frame assemblies. The torque unit assemblies are operable to adjustably generate resistance to fluid flow in first and second opposite directions in response to respective pivotal movements of the upper and lower frame assemblies relative to one another in opposite directions upon flexion and extension of the user's leg. The apparatus also includes a fluid flow control arrangement connected in flow communication with the torque unit assemblies and adjustable to independently preset a desired resistance to fluid flow in each of the first and second opposite directions through the fluid flow control arrangement and thereby independently adjust the amounts of work required to be exerted respectively in flexion and extension of the user's leg. The range of motion limiting arrangement is operable for adjustably presetting limits to pivotal movement of the upper and lower frame assemblies relative to one another and thereby respectively limit flexion and extension of the user's leg.

29 Claims, 3 Drawing Sheets

ADJUSTABLE RESISTANCE KNEE REHABILITATING AND STRENGTHENING APPARATUS

BACKGROUND OF THE INVENTION

1. Field of the Invention

The present invention generally relates to rehabilitation equipment and, more particularly, is concerned with an adjustable resistance knee rehabilitating and strengthening apparatus.

2. Description of the Prior Art

A large, and probably still growing, number of persons participate in various physical fitness activities on a regular basis. The more popular ones of these activities are running, walking, swimming and playing golf or tennis. However, with the greater participation in physical fitness activities comes a corresponding increase in the incidence of injuries. For instance, in U.S. Pat. No. 4,801,138 to Airy et al, it is mentioned that, according to National Center for Disease Statistics, in 1985 there were over 420,000 injuries reported that were attributable to knees alone and that required orthopedic treatment.

Part of the typical treatment for rehabilitating an injured knee is to flex and exercise the joint under controlled load levels. This treatment is ordinarily given at a facility, such as a medical hospital or clinic or a physical therapy center. Sophisticated and expensive machines have been developed for use at these facilities in rehabilitating the muscles and ligaments of the knee joint. However, to use these machines, the patient must leave his or her place of employment or home to travel to the facility to receive the treatment. Then, after the patient has been through the initial rehabilitation treatment, a knee brace is commonly worn during normal daily activities. However, the knee brace frequently interferes with performance of the patient's normal daily activities.

Consequently, a need still exists for the design of an apparatus to use in the rehabilitation of an injured knee which does not have the disadvantages of current rehabilitation treatments.

SUMMARY OF THE INVENTION

The present invention provides an adjustable resistance knee rehabilitating and strengthening apparatus designed to satisfy the aforementioned need. The rehabilitating and strengthening apparatus of the present invention can be employed by a patient on an economical short-term rental basis at home under the directions of a physician or therapist. The apparatus is not to be worn during normal daily activities and need not be used solely at the doctor's or therapist's office or at a medical facility, although certainly it can be employed there also. Thus, the apparatus avoids the problems associated with the prior art treatments.

Accordingly, the present invention is directed to a knee rehabilitating and strengthening apparatus which comprises: (a) a pair of separate upper and lower frame assemblies being securable respectively around a thigh and a shin of a user's leg above and below a knee joint thereof; (b) a pair of separate torque unit assemblies disposed between the upper and lower frame assemblies at opposing lateral sides of and in alignment with the knee joint and pivotally interconnecting the upper and lower frame assemblies, the torque unit assemblies each being operable to generate fluid flow in first and second opposite directions therethrough in response to respective pivotal movements of the upper and lower frame assemblies relative to one another in opposite directions upon flexion and extension of the user's leg; and (c) a fluid flow control arrangement connected in flow communication with the torque unit assemblies and being adjustable to independently preset a desired resistance to fluid flow in each of the first and second opposite directions through the fluid flow control arrangement from and to the torque unit assemblies and thereby independently adjust the amounts of work required to be exerted respectively in flexion and extension of the user's leg.

The apparatus further comprises a range of motion limiting means disposed adjacent to each of the torque unit assemblies and being pivotally movable with the upper and lower frame assemblies. The range of motion limiting means is operable to adjustably preset the limits to pivotal movement of the upper and lower frame assemblies relative to one another and thereby respectively limit flexion and extension of the user's leg.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 9 is an enlarged fragmentary view partly in section of a vane of the torque unit assembly as seen along line 9—9 of FIG. 8.

DETAILED DESCRIPTION OF THE INVENTION

Figure 1:
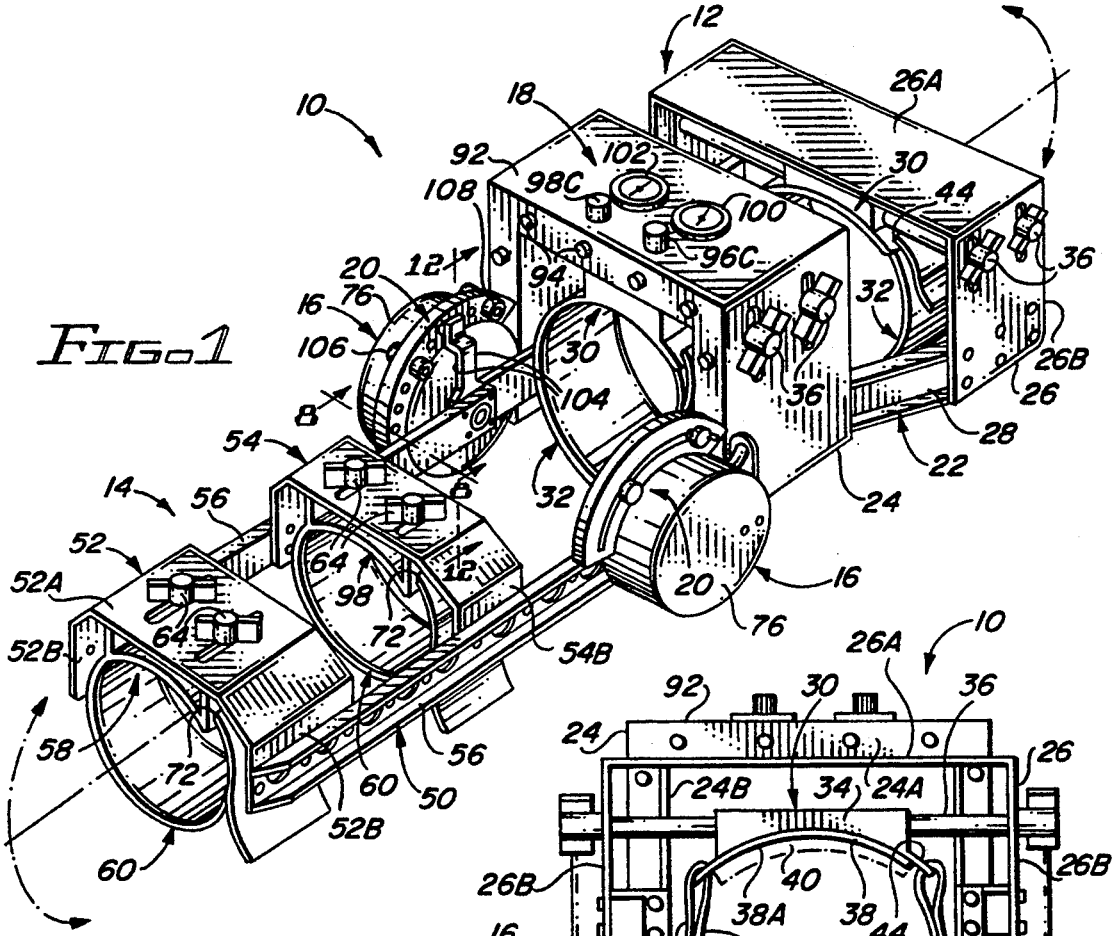
FIG. 1 is a perspective view of an adjustable resistance knee rehabilitating and strengthening apparatus of the present invention.
Figure 3:
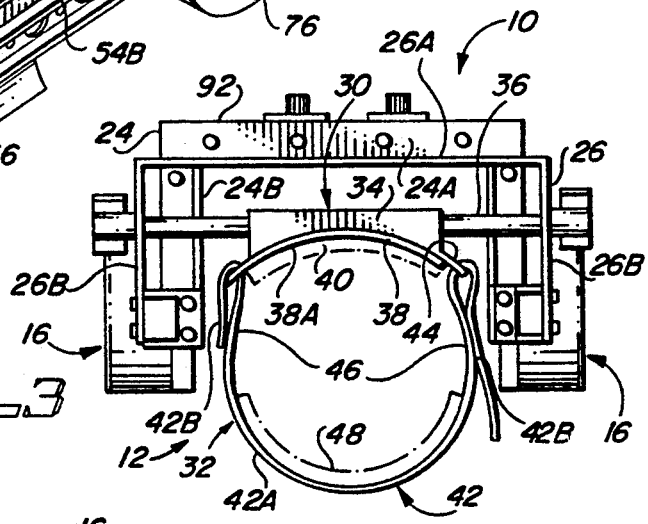
FIG. 3 is a top end view of the apparatus as seen along line 3—3 of FIG. 1.
Figure 2:
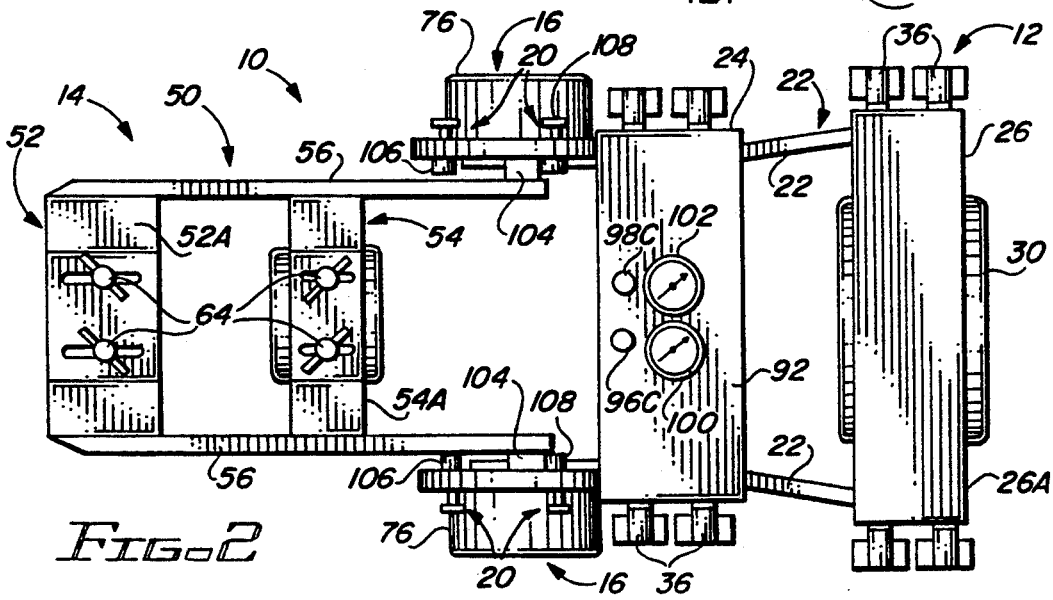
FIG. 2 is a top plan view of the apparatus of FIG. 1.
Figure 4:
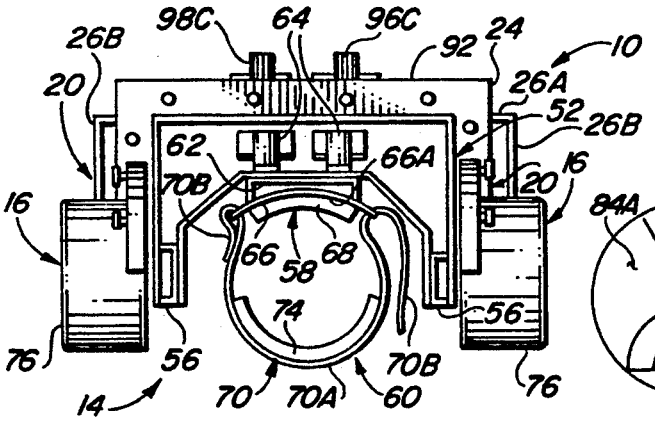
FIG. 4 is a bottom end view of the apparatus as seen along line 4—4 of FIG. 1.
Figure 7:
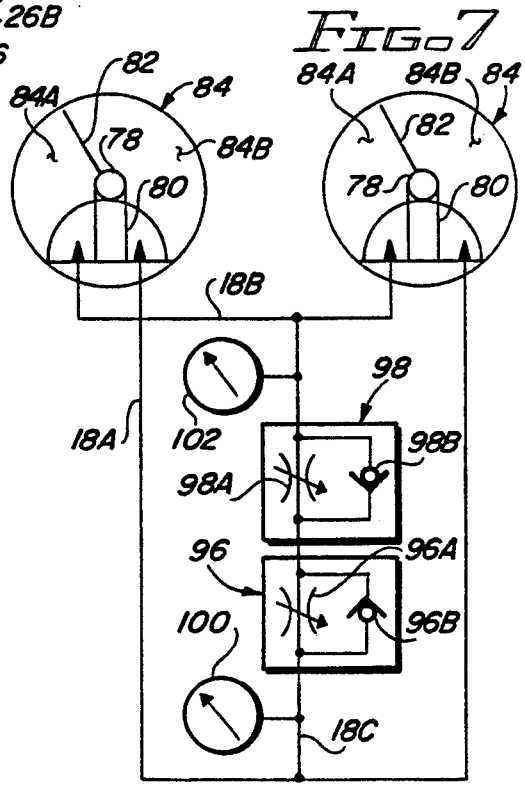
FIG. 7 is a circuit diagram of the fluid flow control arrangement of FIG. 5.
Figure 5:
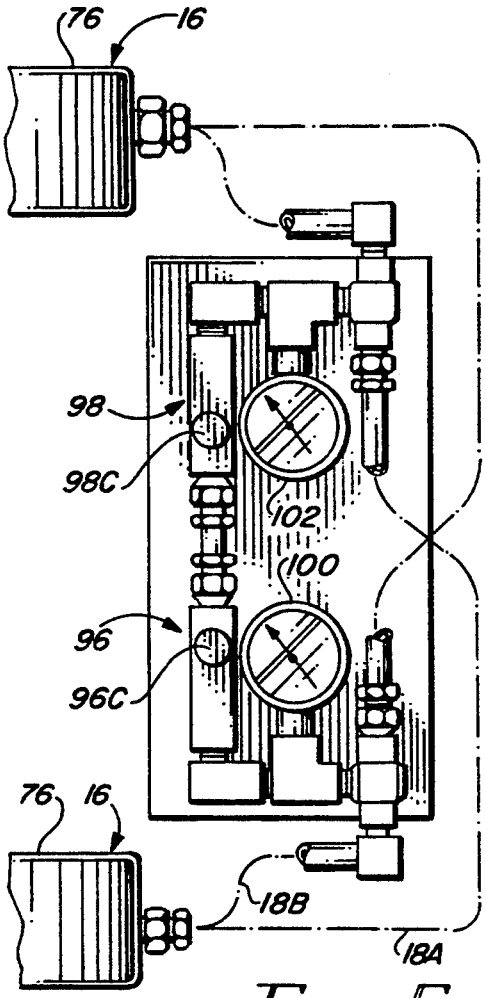
FIG. 5 is a top layout view of a fluid flow control arrangement employed by the apparatus.
Figure 6:
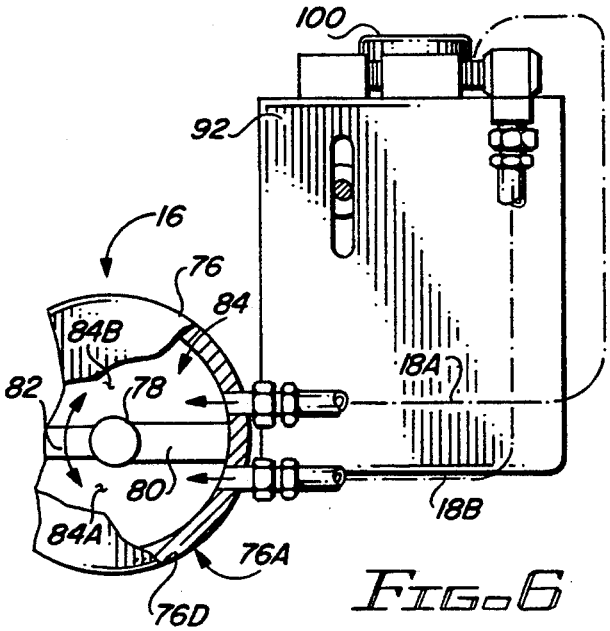
FIG. 6 is a side elevational view of the fluid flow control arrangement of FIG. 5.

Referring to the drawings and particularly to FIGS. 1 to 4, there is illustrated an adjustable resistance knee rehabilitating and strengthening apparatus of the present invention, being generally designated 10. Basically, the rehabilitating and strengthening apparatus 10 includes a pair of upper and lower mounting arrangements 12, 14 being respectively securable around a thigh and a shin of a user's leg above and below a knee joint, a pair of separate torque unit assemblies 16 disposed between the upper and lower mounting arrangements 12, 14 at opposing lateral sides of and in general alignment with the knee joint and pivotally interconnecting the upper and lower mounting arrangements 12, 14, a fluid flow control arrangement 18 (see also FIGS. 5–7) coupled in flow communication with the torque unit assemblies 16, and a pair of range of motion limiting arrangements 20 (see also FIG. 8) disposed adjacent to the torque unit assemblies 16 and coupled with the upper and lower mounting arrangements 12, 14.

The torque unit assemblies 16 are operable concurrently to generate fluid flow in first and second opposite directions therethrough in response to respective pivotal movements of the upper and lower mounting arrangements 12, 14 relative to one another in opposite directions upon flexion and extension of the user's leg. The fluid flow control arrangement 18 is adjustable to independently preset a desired resistance to fluid flow in each of the first and second opposite directions through the fluid flow control arrangement 18 from and to the torque unit assemblies 16 and thereby independently adjust the amounts of work required to be exerted respectively in flexion and extension of the user's leg. The range motion limiting arrangements 20 are operable to adjustably preset the limits to pivotal movement of the upper and lower mounting arrangements 12, 14 relative to one another and thereby respectively limit flexion and extension of the user's leg.

More particularly, the upper mounting arrangement 12 includes an upper frame assembly 22 formed by a pair of forward and aft spaced thigh bridges 24, 26 and a pair of upper side rail members 28, and means in the form of a pair of thigh pad assemblies 30 and pair of thigh strap assemblies 32 for releasably securing the upper frame assembly 22 along the thigh region of the user's leg above the knee joint of the leg. Each thigh bridge 24, 26 includes a top portion 24A, 26A and a pair of opposite side portions 24B, 26B attached to and extending downwardly from opposite ends of the top portion 24A, 26A. The top and side portions 24A, 24B and 26A, 26B together have an inverted substantially U-shaped configuration. The upper side rail members 28 extend along opposite lateral sides of the thigh region of the user's legs and are fixedly attached to the opposite side portions 24B, 26B of the forward and aft thigh bridges 24, 26 so as to dispose the bridges in a tandem relationship to one another.

The thigh pad assemblies 30 are supported from and below the respective top portions 24A, 26A of the forward and aft thigh bridges 24, 26 so as to overlie the front of the thigh region of the user's leg. Each thigh pad assembly 30 includes an upper plate structure 34, a plurality of mounting rods 36 extending between and fastened to the opposite side portions 24B, 26B of the bridges 24, 26 and supporting the upper plate structure 34 between the opposite side portions 24B, 26B and below the top portions 24A, 26A of the bridges 24, 26, and an lower arcuate plate structure 38 defining a concave surface 38A. Each thigh pad assembly 30 also includes a compressible pad 40 fabricated of a suitable material, such as closed cell foam, and mounted to the concave surface 38A of the lower arcuate plate structure 38 for contacting a front of the thigh region of the user's leg.

The thigh strap assemblies 32 are releasably secured to the respective thigh pad assemblies 30 and securable about the thigh region of the user's leg. Each thigh strap assembly 32 includes an elongated strap 42 having a main portion 42A adapted to encircle the opposite sides and back of the thigh of the user's leg and a pair of opposite end portions 42B each being inserted through one of a pair of slots 44 defined at opposite side ends of the lower arcuate plate structure 38. The inserted end portions 42B of the straps 42 are looped back so as to overlie and releasably attach to adjacent ends of the main portion 42A of the strap 42, such as by a conventional hook and loop detachable fastening material 46. Each thigh strap assembly 32 also includes a compressible pad 48 mounted to the main portion 42A of the strap 42 in any suitable way such as by the conventional hook and loop detachable fastening material. The compressible pad 48, also preferably fabricated from a closed cell foam material, contacts the back of the thigh of the user's leg.

Further, the lower mounting arrangement 14 includes a lower frame assembly 50 formed by a pair of forward and aft spaced shin bridges 52, 54 and a pair of lower side rail members 56 and means in the form of a pair of shin pad assemblies 58 and pair of shin strap assemblies 60 for releasably securing the lower frame assembly 50 along the shin region of the user's leg below the knee joint of the leg. Each shin bridge 52, 54 includes a top portion 52A, 54A and a pair of opposite side portions 52B, 54B attached to and extending downwardly from opposite ends of the top portion 52A, 54A. The top and side portions 52A, 52B and 54A, 54B together have an inverted substantially U-shaped configuration. The lower side rail members 56 extend along opposite lateral sides of the shin region of the user's legs and are fixedly attached to the opposite side portions 52B, 54B of the forward and aft shin bridges 52, 54 so as to dispose the bridges in a tandem relationship to one another.

The shin pad assemblies 58 are supported from and below of the respective top portions 52A, 54A of the forward and aft shin bridges 52, 54 so as to overlie the front of the shin region of the user's leg. Each shin pad assembly 58 includes an upper plate structure 62, a plurality of fasteners 64 mounted upright on the upper plate structure 62 and releasably attached to the respective shin bridge 52, 54, and an lower arcuate plate structure 66 defining a concave surface 66A. Each shin pad assembly 58 also includes a compressible pad 68 fabricated from a suitable material, such as closed cell foam, and mounted to the concave surface 66A of the lower arcuate plate structure 66 for contacting a front of the shin region of the user's leg.

The shin strap assemblies 60 are releasably secured to the respective shin pad assemblies 58 and securable about the shin region of the user's leg. Each shin strap assembly 60 includes an elongated strap 70 having a main portion 70A adapted to encircle the opposite sides and back of the shin of the user's leg and a pair of opposite end portions 70B each being inserted through one of a pair of slots 72 defined at opposite side ends of the lower arcuate plate structure 66. The inserted end portions 70B of the straps 70 are looped back so as to overlie and releasably attach to adjacent ends of the main portion 70A of the strap 70, such as by the conventional hook and loop detachable fastening material 46. Each shin strap assembly 60 also includes a compressible pad 74 mounted to the main portion 70A of the strap 70, in any suitable manner such as by use of the conventional hook and loop detachable fastening material. The compressible pad 74, preferably fabricated from a closed cell foam material, contacts the back of the shin region of the user's leg.

Referring to FIGS. 5–12, each torque unit assembly 16 includes a cylindrical housing 76, a rotary shaft 78, a shoe element 80 and a rotary vane 82. Each housing 76 is formed by an outer cup-shaped base 76A and an inner planar-shaped cover 76B attached thereon by screws 83 (FIG. 8) to defined an interior chamber 84 in the housing 76. The housings 76 at the exterior of the covers 76B thereof are fixedly attached to forward ends 28A of the upper side rail members 28 of the upper frame assembly 22.

Figure 8:
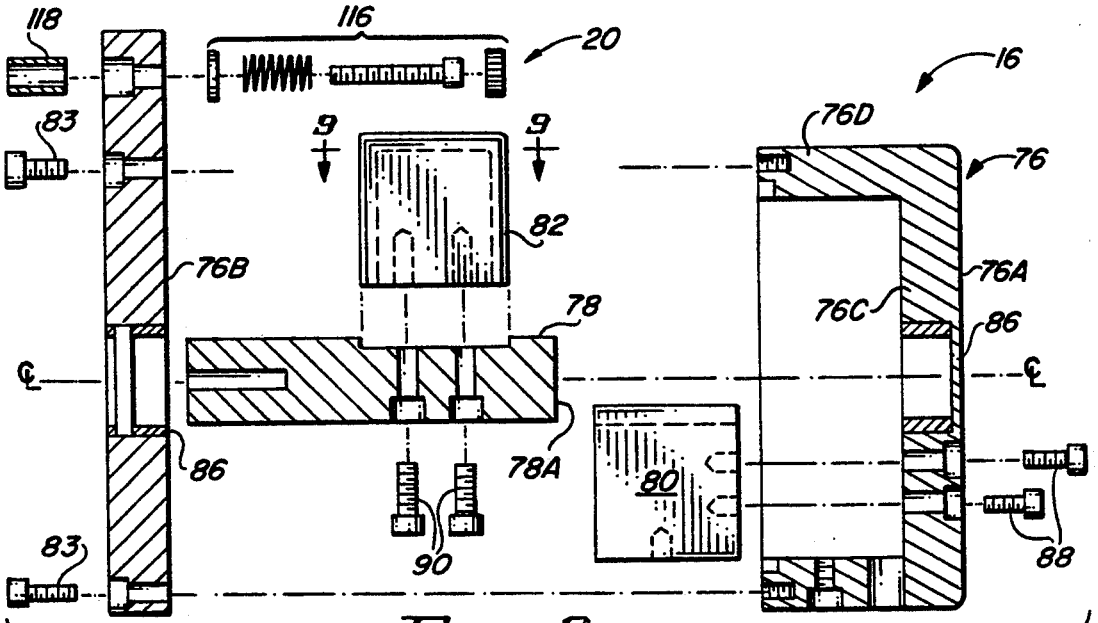
FIG. 8 is an enlarged exploded view partly in section of one of a pair of torque unit assemblies of the apparatus taken along line 8—8 of FIG. 1.
Figure 4:
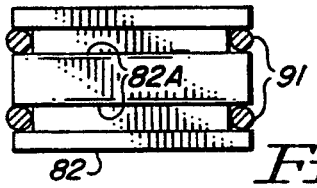
Figure 11:
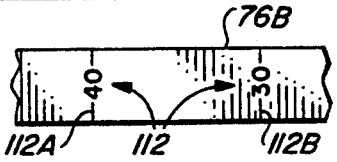
FIG. 11 is an enlarged fragmentary plan view as seen along line 11—11 of FIG. 10.
Figure 10:
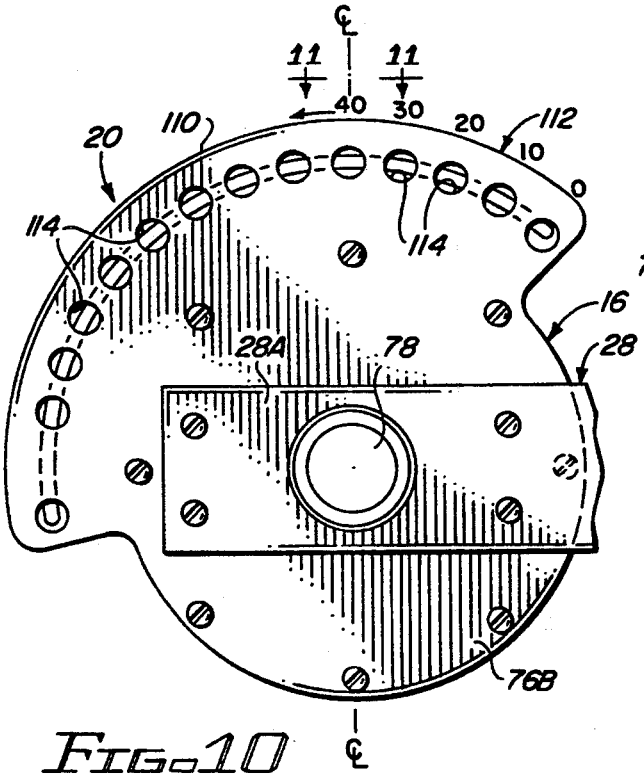
FIG. 10 is an enlarged end elevational view of a cover of the torque unit assembly as seen along line 10—10 of FIG. 8.
Figure 12:
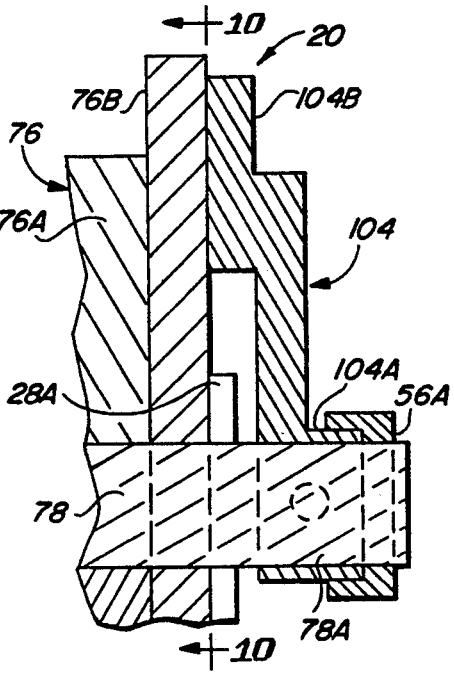
FIG. 12 is an enlarged sectional view of one of a pair of torque lever arms disposed adjacent to the cover and attached on a shaft of a corresponding one of the torque unit assemblies.

The rotary shafts 78 are rotatably mounted along a common axis through the respective housings 76 by annular bushings 86 (FIG. 8). The shafts 78 have inner end portions 78A axially protruding from the inner covers 76B of the housings 76. In a manner described hereinafter, the rearward ends 56A of the lower side rail members 56 of the lower frame assembly 50 are respectively fixedly attached the inner end portions 78A of the rotary shafts 78. The shoe element 80 is stationary mounted by screws 88 to the end wall 76C of the housing base 76A and is disposed in the interior chamber 84 of the housing 76, extending in radial relation between the shaft 78 and the peripheral wall 76D of the housing base 76A. The rotary vane 82 is fixedly mounted by screws 90 to the rotary shaft 78 and disposed in the housing 76, extending in radial relation between the shaft 78 and the peripheral wall 76D of the housing base 76A, such that the vane 82 rotates with the shaft 78. The shoe element 80, rotary shaft 78 and rotary vane 82 together provide a partition across the interior chamber 84 which is sealed with the interior surface of the housing 76 and divides the interior chamber 84 of the housing 76 into first and second portions 84A, 84B on opposite sides of the movable wall. It should be noted that the portion of the partition formed by the vane 82 is movable in a circumferential direction about the shaft 78 and is sealed with the interior surface of the housing 76 by a pair of seal elements 91 seated in a pair of recesses 82A formed about the periphery of the vane 82. The respective volumes of the first and second chamber portions 84A, 84B change in an inverse relation to one another as the vane 82 is moved in the chamber 84.

Referring to FIGS. 1 and 5–7, the fluid flow control arrangement 18 mounted on the forward thigh bridge 24 and hidden under a cover 92 which is fitted over and attached by screws 94 to the bridge 24. The fluid flow control arrangement 18 has conduits and tee and elbow connectors defining a pair of first and second flow branches 18A, 18B and a third flow branch 18C. The first and second flow branches 18A, 18B are coupled to the housings 76 of the torque unit assemblies 16 so as to separately interconnect in flow communication the first portions 84A of the chambers 84 with one another and the second portions 84B of the chambers 84 with one another. The third flow branch 18C extends between and interconnects the first and second flow branches 18A, 18B.

The fluid flow control arrangement 18 also includes a pair of first and second flow control devices 96, 98 each operable to permit fluid flow therethrough in either one or the other of two opposite directions and being adjustable to preset a desired resistance to, or restriction of, fluid flow therethrough in one but not the other of the two opposite directions. The first and second flow control devices 96, 98 are serially interposed in the third flow branch 18C and each is formed by an adjustable flow restriction 96A, 98A and a one-way check valve 96B, 98B arranged in parallel with one another such that fluid flow through the first flow control device 96 encounters resistance only in a first direction while fluid flow through the second flow control device 98 encounters resistance only in a second direction being opposite to the first direction. As a result, fluid flow proceeds against a first preset resistance or restriction 96A in the first flow control device 96 from the first chamber portions 84A of the housings 76 to the second chamber portions 84B thereof, whereas fluid flow proceeds against a second preset resistance or restriction 98A in the second flow control device 98, being independent of the first preset resistance or restriction 96A, from the second chamber portions 84B of the housings 76 to the first chamber portions thereof, in response to bi-directional rotary movement of the shaft 78 and vanes 82 about a common axis in the housing chambers 84 caused by pivotal movement of the upper and lower frame assemblies 22, 50 relative to one another. Therefore, the amounts of work required to be exerted respectively in flexion and extension of the user's leg is adjustable and can be preset independently of one another by turning control knobs 96C, 98C on the first and second flow control devices 96, 98 which are disposed above the cover 92. Also, a pair of pressure gages 100, 102 are coupled in flow communication with the third flow branch 18C upstream of the respective first and second flow control device 96, 98 to provide a readout of the pressure settings of the respective devices.

Referring to FIGS. 1, 2, 4, 8 and 10–12, the range of motion limiting arrangements 20 are respectively disposed adjacent to the torque unit assemblies 16 and are each respectively coupled with the upper and lower frame assemblies 22, 50 for adjustably presetting limits to the pivotal movement of the upper and lower frame assemblies 22, 50 relative to one another and thereby respectively limit flexion and extension of the user's leg. Each of the range of motion limiting arrangements 20 associated with one of the torque unit assemblies 16 includes a pivotal arm 104, a pair of stops 106, 108, and an angular radial extension 110 on each of the housing covers 76B. Each extension 110 has a degrees scale 112 on its peripheral edge with markings being displaced 10° from one another, and an arcuate pattern of holes 114 formed through the extension being aligned with markings 112A on the degrees scale 112.

The pivotal arms 104 at their inner ends 104A are respectively attached about the inner end portions 78A of the rotary shafts 78 of the torque unit assemblies 16. The rearward ends 56A of the lower side rail members 56 of the lower frame assembly 50 are fixedly attached to the inner ends 104A of the pivotal arms 104 by screws 116 such that the shafts 78, vanes 82, pivotal arms 104 and lower frame assembly 50 all move together relative to the housings 76 and upper frame assembly 22. Thus, the outer ends 104B of the pivotal arms 104 move in respective arcuate paths as the shafts 76 are rotated by pivotal movement of the upper and lower frame assemblies 22, 50 relative to one another.

The pairs of stops 106, 108 are positioned along the respective housing cover arcuate extensions 110 and seated in selected pairs of the holes 114 therethrough such that they extend across the respective arcuate paths of pivotal movement of pivotal arms 104 for presetting limits to pivotal movement of the arm 104 and thereby establish the arc or range of motion through which the upper and lower frame assemblies 22, 50 are allowed to pivotally move relative to one another and also thereby the range of motion of the knee joint in flexion and extension of the user's leg. Each stop 106, 108 includes a spring-loaded fastener knob assembly 116 threadably connected to an annular stop element 118 so as to retain the stop element 118 seated in a selected one of the holes 114 and projecting therefrom across the arcuate path of the pivotal arm 104. In such manner, the positions of the stops 106, 108 of each pair are adjustable with respect to one another to change the distance between the limits defined by the stops 106, 108.

From the foregoing detailed description, it is readily understood that the knee rehabilitating and strengthening apparatus 10 of the present invention is a unique device that can be advantageously used for post-surgical rehabilitation as well as other rebuilding and strengthening applications.

To accommodate varying patient leg sizes and ensure proper securement to the leg so as to avoid creation of shear forces on the knee joint, the apparatus 10 employs the forward and aft thigh and shin bridges 24, 26 and 52, 54 and the adjustable thigh and shin pad and strap assemblies 30, 32 and 58, 60 which encompass and engage with the thigh (femur) and shin (tibia) regions of the user's leg. The apparatus 10 allows desired flexion and extension of an injured knee while minimizing medial or lateral motion. Also, the components of the apparatus 10 are constructed of structurally strong but relatively lightweight materials.

Further, the apparatus 10 has an adjustable resistance capability adapting it for the varying needs of rehabilitation. In addition, the adjustability of the resistance for leg extension and leg flexion are independently controlled. The resistance adjustability ranges from approximately 1 to 130 foot-pounds of torque at the knee joint. To provide the required adjustable resistance, the unique torque unit assemblies 16 are provided to pivotally couple the upper and lower frame assemblies 22, 50 which are secured to the thigh and shin regions of the leg. The torque unit assemblies 16 are located at the outer and inner sides of the knee joint and share a common pivotal axis with the knee joint. The fluid flow control arrangement 18, being coupled with the torque unit assemblies 16, includes the pair of flow control devices 96, 98 and the pair of pressure gages 100, 102 which are utilized to adjust and monitor the amount of resistance desired both in flexion and extension of the leg. The operating pressure of the fluid is adjustable from a minimum of about 1–2 psi to a maximum of about 600 psi. A hydraulic fluid, such as silicone, is preferred as the fluid medium used by the torque unit assemblies 16 because of its excellent lubricity properties.

Also, the range of motion of the apparatus 10 is adjustable for both flexion and extension of the leg. The range of motion adjustability is controlled by two spring-loaded stops 106, 108 that positively limit rotation of pivot arms 104 keyed to rotary shafts 78 of the respective torque unit assemblies 16.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A knee rehabilitating and strengthening apparatus, comprising:

(a) an upper arrangement adapted to be securable around a thigh of a user's leg above a knee joint thereof, said upper arrangement including an upper frame assembly and first means mounted to said upper frame assembly for releasably securing said upper frame assembly along the user's thigh, said upper frame assembly having a pair of opposite forward and rearward ends;

(b) a lower arrangement adapted to be securable around a shin of the user's leg below the knee joint thereof, said lower arrangement including a lower frame assembly and second means mounted to said lower frame assembly for releasably securing said lower frame assembly along the user's shin, said lower frame assembly having a pair of opposite forward and rearward ends, said forward end of said lower frame assembly being located remote from said rearward end of said upper frame assembly, said rearward end of said lower frame assembly being located adjacent to said forward end of said upper frame assembly;

(c) a pair of separate torque unit assemblies disposed between said upper and lower frame assemblies and being attached to said forward end of said upper frame assembly and to said rearward end of said lower frame assembly located adjacent to said forward end of said upper frame assembly, said torque unit assemblies adapted to be disposed at opposing lateral sides of the knee joint and define a common rotational axis adapted to be generally aligned with the knee joint and about which said upper and lower frame assemblies undergo pivotal movement relative to one another, said torque unit assemblies each being operable to generate fluid flow in first and second opposite directions therethrough in response to respective pivotal movements of said upper and lower frame assemblies relative to one another in opposite directions upon flexion and extension of the user's leg; and (d) a fluid flow control arrangement connected in flow communication with said torque unit assemblies such that said torque unit assemblies are connected in flow communication with one another through said control arrangement, said control arrangement being adjustable to independently preset a desired resistance to fluid flow in each of said first and second opposite directions through said control arrangement from and to said torque unit assemblies and thereby independently adjust the amounts of work exerted respectively in flexion and extension of the user's leg.

2. The apparatus of claim 1 wherein said upper frame assembly includes a pair of forward and aft thigh bridges adapted for extending over the thigh region of the user's leg and adjacent to opposite lateral sides thereof.

3. The apparatus of claim 2 wherein each of said thigh bridges includes a top portion and a pair of opposite side portions attached to and extending downwardly from opposite ends of said top portion, said top and side portions together having an inverted substantially U-shaped configuration.

4. The apparatus of claim 2 wherein said first means includes:

a pair of thigh pad assemblies each being supported by one of said forward and aft thigh bridges and adapted to be over the thigh region of the user's leg; and a pair of thigh strap assemblies each adapted to be releasably securable about the thigh region of the user's leg.

5. The apparatus of claim 4 wherein each of said thigh pad assemblies includes:

an upper plate structure;

a plurality of fasteners mounted upright on said upper plate structure and releasably attached to said respective thigh bridge;

an lower arcuate plate structure defining a concave surface; and a compressible pad mounted to said concave surface of said lower arcuate plate structure and adapted for contacting a front of the thigh of the user's leg.

6. The apparatus of claim 2 wherein said upper frame assembly also includes a pair of upper side rail members adapted for extending along opposite lateral sides of the thigh region of the user's legs and being attached to said forward and aft thigh bridges so as to dispose said bridges in a tandem relationship to one another, said upper side rail members having respective forward ends defining said forward end of said upper frame assembly and being attached to said respective torque unit assemblies.

7. The apparatus of claim 1 wherein said lower frame assembly includes a pair of forward and aft shin bridges adapted for extending over a shin region of the user's leg and adjacent to opposite lateral sides thereof.

8. The apparatus of claim 7 wherein each of said shin bridges includes a top portion and a pair of opposite side portions attached to and extending downwardly from opposite ends of said top portion, said top and side portions together having an inverted substantially U-shaped configuration.

9. The apparatus of claim 7 wherein aid second means includes:

a pair of shin pad assemblies each being supported by one of said forward and aft shin bridges and adapted to be over the shin region of the user's leg; and a pair of shin strap assemblies each adapted to be releasably securable about the shin region of the user's leg.

10. The apparatus of claim 9 wherein each of said shin pad assemblies includes:

an upper plate structure;

a plurality of fasteners mounted upright on said upper plate structure and releasably attached to said respective shin bridge;

an lower arcuate plate structure defining a concave surface; and a compressible pad mounted to said concave surface of said lower arcuate plate structure and adapted for contacting a front of the user's leg.

11. The apparatus of claim 7 wherein said lower frame assembly also includes a pair of lower side rail members adapted for extending along opposite sides of the shin region of the user's legs and being attached to said forward and aft shin bridges so as to dispose said bridges in a tandem relationship to one another, said lower side rail members having respective rearward ends defining said rearward end of said lower frame assembly and being attached to said respective torque unit assemblies.

12. The apparatus of claim 1 wherein each of said torque unit assemblies includes:

a housing fixedly attached to one of said forward and rearward ends of said respective upper and lower frame assemblies and defining an interior chamber;

a shaft rotatably mounted through said housing and fixedly attached to the other of said forward and rearward ends of said respective upper and lower frame assemblies;

a shoe element stationary mounted in said interior chamber of said housing; and a rotary vane disposed in said housing and fixedly mounted to said shaft and rotatable therewith relative to said housing and said shoe element, said vane, shaft and shoe coacting to divide said interior chamber into first and second portions located on opposite sides of said vane, shaft and shoe.

13. The apparatus of claim 12 wherein said fluid flow control arrangement includes:

a pair of first and second flow branches being respectively coupled to said housings of said torque unit assemblies so as to separately interconnect in flow communication said first portions of said chambers with one another and said second portions of said chambers with one another;

a third flow branch extending between and interconnecting said fist and second flow branches; and a pair of first and second flow control devices each operable to permit fluid flow therethrough in either one or the other of two opposite directions and being adjustable to preset a desired resistance to fluid flow therethrough in one but not the other of said two opposite directions, said first and second flow control devices being interposed in said third flow branch such that fluid flow through said first flow control device encounters resistance in said first direction while fluid flow through said second flow control device encounters resistance in said second direction being opposite to said first direction whereby fluid flow can proceed against a first preset resistance from said first portions of said housing chambers to said second portions thereof whereas fluid flow can proceed against a second preset resistance independent of said first preset resistance from said second portions of said housing chambers to said first portions thereof in response to rotary movement of said vanes and shaft in said housing chambers produced by pivotal movement of said upper and lower arrangements relative to one another.

14. The apparatus of claim 12 further comprising:

range of motion limiting means disposed adjacent to each of said torque unit assemblies and being coupled with said upper and lower frame assemblies for adjustably presetting limits to pivotal movement of said upper and lower frame assemblies relative to one another and thereby respectively limit flexion and extension of the user's leg.

15. The apparatus of claim 14 wherein said range of motion limiting means includes:

a pair of pivotal arms each attached to said shaft of one of said torque unit assemblies and rotatable therewith to move in a respective arcuate path with said one of said upper and lower frame assemblies;

a pair of support structures disposed along said respective housings and adjacent to each of said pivotal arms along said arcuate paths thereof, each support structure having a plurality of holes spaced apart and extending in an arcuate pattern corresponding to the arcuate path of said pivotal arm; and a pair of stops disposed in selected pairs of said holes of each structure and being positioned along and extending across said arcuate path of pivotal movement of each one of said pivotal arms for presetting limits to pivotal movement of said one arm and thereby to pivotal movement of said upper and lower arrangements relative to one another and to flexion and extension of the user's leg, said positions of said stops of each pair being adjustable with respect to one another to other selected pairs of said holes to change the distance between the limits defined by said stops.

16. The apparatus of claim 15 wherein each of said support structures has an arcuate-shaped degrees scale thereon.

17. The apparatus of claim 16 wherein each of said degrees scales includes a plurality of markings being displaced from one another by the same amount that said holes are displaced from one another.

18. The apparatus of claim 14 wherein said range of motion limiting means includes:

a pair of pivotal arms attached to said shaft of one of said torque unit assemblies and rotatable therewith to move in a respective arcuate path with said one of said upper and lower frame assemblies; and a pair of stops positioned along said housing of each of said torque unit assemblies and extending across said arcuate path of pivotal movement of a respective one of said pivotal arms for presetting limits to pivotal movement of said one arm and thereby to pivotal movement of said upper and lower frame assemblies relative to one another and to flexion and extension of the user's leg, said positions of said stops of each pair being adjustable with respect to one another to change the distance between the limits defined by said stops.

19. A knee rehabilitating and strengthening apparatus, comprising:

(a) an upper frame assembly having a pair of opposite forward and rearward ends;

(b) first means mounted to said upper frame assembly adapted for releasably securing said upper frame assembly along a thigh region of a user's leg above a knee joint thereof;

(c) a lower frame assembly having a pair of opposite forward and rearward ends, said forward end of said lower frame assembly being located remote from said rearward end of said upper frame assembly, said rearward end of said lower frame assembly being located adjacent to said forward end of said upper frame assembly;

(d) second means mounted to said lower frame assembly adapted for releasably securing said lower frame assembly along a shin region of the user's leg below the knee joint thereof;

(e) a pair of separate torque unit assemblies disposed between said upper and lower frame assemblies and being attached to said forward end of said upper frame assembly and to said rearward end of said lower frame assembly located adjacent to said forward end of said upper frame assembly, said torque unit assemblies adapted to be disposed at opposing lateral sides of the knee joint and define a common rotational axis adapted to be generally aligned with the knee joint and about which said upper and lower frame assemblies undergo pivotal movement relative to one another, each of said torque unit assemblies including (i) a housing fixedly attached to said forward end of said upper frame assembly and defining an interior chamber, (ii) a shaft rotatably mounted through said housing and fixedly attached to said rearward end of said lower frame assembly, (iii) a shoe element stationary mounted in said interior chamber of said housing; and (iv) a rotary vane fixedly mounted to said shaft and disposed in said housing such that together said shoe, shaft and vane on opposite sides thereof divide said interior chamber into first and second portions; and (f) a fluid flow control arrangement including (i) a pair of first and second flow branches being respectively coupled to said housing of said torque unit assemblies so as to separately interconnect in flow communication said first portions of said chambers with one another and said second portions of said chambers with one another, (ii) a third flow branch extending between and interconnecting said first and second flow branches, and (iii) a pair of first and second flow control devices each operable to permit fluid flow therethrough in either one or the other of two opposite directions and being adjustable to preset a desired resistance to fluid flow therethrough in one but not the other of said two opposite directions, said first and second flow control devices being interposed in said third flow branch such that fluid flow through said first flow control device encounters resistance only in said first direction while fluid flow through said second flow control device encounters resistance only in said second direction being opposite to said first direction whereby fluid flow proceeds against a first preset resistance from said first portions of said housing chambers to said second portions thereof whereas fluid flow proceeds against a second preset resistance, independent of said first preset resistance, from said second portions of said housing chambers to said first portions thereof in response to rotary movement of said vanes and shaft in said housing chambers by pivotal movement of said upper and lower frame assemblies relative to one another whereby the amounts of work required to be exerted respectively in flexion and extension of the user's leg is adjustable and preset independently of one another.

20. The apparatus of claim 19 wherein said upper frame assembly includes a pair of forward and aft thigh bridges adapted for extending over the thigh region of the user's leg and adjacent to opposite lateral sides thereof.

21. The apparatus of claim 20 wherein said first means includes:

a pair of thigh pad assemblies each being supported by one of said forward and aft thigh bridges and adapted to be over the thigh region of the user's leg; and a pair of thigh strap assemblies each adapted to be releasably securable about the thigh region of the user's leg.

22. The apparatus of claim 20 wherein said upper frame assembly also includes a pair of upper side rail members adapted for extending along opposite lateral sides of the thigh region of the user's legs and being attached to aid forward and aft thigh bridges so as to dispose said bridges in a tandem relationship to one another, said upper side rail members having respective forward ends defining said forward end of said upper frame assembly and being attached to said housings of said respective torque unit assemblies.

23. The apparatus of claim 19 wherein said lower frame assembly includes a pair of forward and aft shin bridges adapted for extending over the shin region of the user's leg and adjacent to opposite lateral sides thereof.

24. The apparatus of claim 23 wherein said second means includes:

a pair of shin pad assemblies each being supported by one of said forward and aft shin bridges and adapted to be over the shin region of the user's leg; and a pair of shin strap assemblies each adapted to be releasably securable about the shin region of the user's leg.

25. The apparatus of claim 23 wherein said lower frame assembly also includes a pair of lower side rail members adapted for extending along opposite sides of the shin region of the user's legs and being attached to said forward and aft shin bridges so as to dispose said bridges in a tandem relationship to one another, said lower side rail members having respective rearward ends defining said rearward end of said lower frame assembly and being attached to said respective shafts of said torque unit assemblies.

26. A knee rehabilitating and strengthening apparatus, comprising:

(a) a pair of separate upper and lower arrangements adapted to be securable respectively around a thigh and a shin of a user's leg above and below a knee joint thereof, said upper arrangement including (i) an upper frame assembly having a pair of forward and aft thigh bridges adapted for extending over the thigh region of the user's leg and adjacent to opposite lateral sides thereof, and (ii) first means mounted to said upper frame assembly for releasably securing said upper frame assembly along the thigh region of a user's leg above the knee joint, said first means having a pair of thigh pad assemblies each being supported by one of aid forward and aft thigh bridges over the thigh region of the user's leg, and a pair of thigh strap assemblies each being releasably securable about the thigh region of the user's leg and including an upper plate structure, a plurality of fasteners mounted upright on said upper plate structure and releasably attached to said respective thigh bridge, an lower arcuate plate structure defining a concave surface and a compressible pad mounted to said concave surface of said lower arcuate plate structure for contacting a front of the thigh of the user's leg;

(b) a pair of separate toque unit assemblies disposed between said upper and lower arrangements at opposing lateral sides of and adapted to be aligned with the knee joint and pivotally interconnecting the upper and lower arrangements, said torque unit assemblies each being operable to generate fluid flow in first and second opposite directions therethrough in response to respective pivotal movements of said upper and lower arrangements relative to one another in opposite directions upon flexion and extension of the user's leg; and (c) a fluid flow control arrangement connected in flow communication with said torque unit assemblies and being adjustable to independently preset a desired resistance to fluid flow in each of said first and second opposite directions through said control arrangement from and to said torque unit assemblies and thereby independently adjust the amounts of work exerted respectively in flexion and extension of the user's leg.

27. The apparatus of claim 26 wherein each of said thigh strap assemblies includes:

an elongated strap having a main portion adapted to encircle the opposite sides and back of the thigh of the user's leg and a pair of opposite end portions each being inserted through one of a pair of slots defined at opposite side ends of said lower arcuate plate structure, said inserted end portions of said straps being looped back so as to overlie and releasably attach to adjacent ends of said main portion of said strap; and a compressible pad mounted to said main portion of said strap and adapted for contacting the back of the thigh of the user's leg.

28. A knee rehabilitating and strengthening apparatus, comprising:

(a) a pair of separate upper and lower arrangements being securable respectively around a thigh and a shin of a user's leg above and below a knee joint thereof, said lower arrangement including (i) a lower frame assembly having a pair of forward and aft shin bridges for extending over the shin region of the user's leg and adjacent to opposite lateral sides thereof, and (ii) second means mounted to said lower frame assembly for releasably securing said lower frame assembly along a shin region of the user's leg below the knee joint thereof, said second means having a pair of shin pad assemblies each being supported by one of said forward and aft shin bridges over the shin region of the user's leg and a pair of shin strap assemblies each being releasably securable about the shin region of the user's leg, each of said shin pad assemblies including an upper plate structure, a plurality of fasteners mounted upright on said upper plate structure and releasably attached to said respective shin bridge, an lower arcuate plate structure defining a concave surface, and a compressible pad mounted to said concave surface of said lower arcuate plate structure for contacting a front of the user's leg;

(b) a pair of separate torque unit assemblies disposed between said upper and lower arrangements at opposing lateral sides of and in alignment with the knee joint and pivotally interconnecting the upper and lower arrangements, said torque unit assemblies each being operable to generate fluid flow in first and second opposite directions therethrough in response to respective pivotal movements of said upper and lower arrangements relative to one another in opposite directions upon flexion and extension of the user's leg; and (c) a fluid flow control arrangement connected in flow communication with said torque unit assemblies and being adjustable to independently preset a desired resistance to fluid flow in each of said first and second opposite directions through said control arrangement from and to said torque unit assemblies and thereby independently adjust the amounts of work exerted respectively in flexion and extension of the user's leg.

29. The apparatus of claim 28 wherein each of said shin strap and adapted assemblies includes:

an elongated strap having a main portion adapted to encircle the opposite sides and back of the shin of the user's leg and a pair of opposite end portions each being inserted through one of a pair of slots defined at opposite side ends of said lower arcuate plate structure, said inserted end portions of said straps being looped back so as to overlie and releasably attach to adjacent ends of said main portion of said strap; and a compressible pad mounted to said main portion of said strap for contacting the back of the shin of the user's leg.

* * * * *